US010500869B2

(12) United States Patent
Matsumura

(10) Patent No.: US 10,500,869 B2
(45) Date of Patent: Dec. 10, 2019

(54) INK JET RECORDING APPARATUS

(71) Applicant: CANON KABUSHIKI KAISHA, Tokyo (JP)

(72) Inventor: Hideaki Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/957,722

(22) Filed: Apr. 19, 2018

(65) Prior Publication Data

US 2018/0311967 A1 Nov. 1, 2018

(30) Foreign Application Priority Data

Apr. 28, 2017 (JP) ..... 2017-089516

(51) Int. Cl.

| | |
|---|---|
| ***B41J 2/175*** | (2006.01) |
| ***B41J 2/17*** | (2006.01) |
| ***B41J 29/02*** | (2006.01) |
| ***B41J 29/38*** | (2006.01) |
| ***B41J 2/165*** | (2006.01) |

(52) U.S. Cl.

CPC ..... *B41J 2/17596* (2013.01); *B41J 2/16517* (2013.01); *B41J 2/1707* (2013.01); *B41J 2/17509* (2013.01); *B41J 29/02* (2013.01); *B41J 29/38* (2013.01)

(58) Field of Classification Search

None

See application file for complete search history.

(56) References Cited

U.S. PATENT DOCUMENTS

| | | | | |
|---|---|---|---|---|
| 2007/0204912 | A1* | 9/2007 | Hanada | G05D 11/132 137/487.5 |
| 2012/0038719 | A1* | 2/2012 | Shimizu | B41J 2/17523 347/86 |
| 2012/0050421 | A1* | 3/2012 | Hamasaki | B41J 2/17509 347/85 |
| 2015/0022582 | A1* | 1/2015 | Katsuragi | B41M 5/0017 347/21 |

(Continued)

FOREIGN PATENT DOCUMENTS

| | | | |
|---|---|---|---|
| CN | 1386093 | A | 12/2002 |
| CN | 102336061 | A | 2/2012 |
| CN | 102582258 | A | 7/2012 |

(Continued)

*Primary Examiner* — Matthew Luu
*Assistant Examiner* — Tracey M McMillion
(74) *Attorney, Agent, or Firm* — Canon U.S.A., Inc. IP Division

(57) ABSTRACT

An ink jet recording apparatus includes a recording head that ejects ink, an ink tank including an ink storage chamber and an air storage chamber. The ink storage chamber stores ink. The air storage chamber supplies air to the ink storage chamber along with supply of ink from the ink storage chamber to the recording head. An ink supply path communicates with the air storage chamber without passing the ink storage chamber. A valve switches between an open state in which the ink storage chamber communicates with the ink supply path and with the air storage chamber, and a close state in which the communication between the ink storage chamber and the ink supply path is blocked and the communication between the ink storage chamber and the air storage chamber is blocked.

12 Claims, 9 Drawing Sheets

(56) References Cited

U.S. PATENT DOCUMENTS

2016/0200113 A1* 7/2016 Nanjo ..... B41J 2/17526
347/86

FOREIGN PATENT DOCUMENTS

| | | | |
|---|---|---|---|
| CN | 102869516 | A | 1/2013 |
| CN | 204196454 | U | 3/2015 |
| CN | 105034604 | A | 11/2015 |
| CN | 205364840 | U | 7/2016 |
| CN | 105829109 | A | 8/2016 |
| CN | 106042652 | A | 10/2016 |
| CN | 106560322 | A | 4/2017 |
| JP | 2012-020495 | A | 2/2012 |
| JP | 2015-143031 | A | 8/2015 |

* cited by examiner

INK JET RECORDING APPARATUS

BACKGROUND OF THE INVENTION

Field of the Invention

The present disclosure relates to an ink jet recording apparatus that ejects ink and records an image.

Description of the Related Art

An ink jet recording apparatus discussed in Japanese Patent Publication Laid-Open No. 2015-143031 includes an ink tank having a filling port through which a user can fill the ink tank with ink. The ink injected into the ink tank is supplied to a recording head via a tube or the like. Further, a valve unit which can open and close a flow path in the tube is disposed at a middle of the tube. The vale unit is closed during transportation of the recording apparatus so that a leakage of the ink can be prevented.

However, in a configuration discussed in Japanese Patent Publication Laid-Open No. 2015-143031, ink might occasionally flow into an air storage chamber from an ink storage chamber of the ink tank during transportation. Since the air storage chamber has an atmosphere communication port and communicates with atmosphere, the ink which flows into the air storage chamber when the recording apparatus has been tilted during transportation, can leak from the atmosphere communication port.

SUMMARY OF THE INVENTION

The present disclosure is directed to an ink jet recording apparatus capable of preventing a leakage of ink.

According to an aspect of the present disclosure, an ink jet recording apparatus includes a recording head including an ejection port surface provided with a plurality of ejection ports for ejecting ink, an ink tank that includes a filling port for filling ink, an ink storage chamber that stores ink filled through the filling port, the air storage chamber configured to be connected to the ink storage chamber and to communicate with atmosphere, an ink supply path that supplies ink from the ink storage chamber to the recording head, the ink supply path being capable of communicating with the air storage chamber without passing through the ink storage chamber, and a valve that switches between an open state in which the ink storage chamber communicates with the ink supply path and with the air chamber, and a close state which the communication between the ink storage chamber and the ink supply path is blocked and the communication between the ink storage chamber and the air chamber is blocked.

Further features and various aspects of the present disclosure will become apparent from the following description of numerous example embodiments with reference to the attached drawings.

DESCRIPTION OF THE EMBODIMENTS

An ink jet recording apparatus according to numerous example embodiments of the present disclosure will be described. Constituent elements described in the example embodiments are only examples, and is not intended to limit the scope of the present disclosure. The specification will describe, as an example, a serial type ink jet recording apparatus that performs recording while a recording head for ejecting ink to recording media which is conveyed intermittently is being reciprocally moved in a direction intersecting a conveyance direction of the recording media. However, the present disclosure is applicable not only to the serial type ink jet recording apparatus but also to a line type ink jet recording apparatus that sequentially performs printing by means of a long-length print head. In the specification, "ink" is used as a general term for a liquid such as a recording liquid. Further, in the specification, "recording" refers to not only recording on flat-surface objects but also recording on three-dimensional objects. In the specification, "recording medium" is used as a general term for a recording medium, such as paper, fabric, a plastic film, a metal plate, glass, ceramics, lumber, or leather, to which the liquid is ejected. Further, the recording medium refers to not only cut paper but also roll-shaped continuous-form paper.

Figure 1:
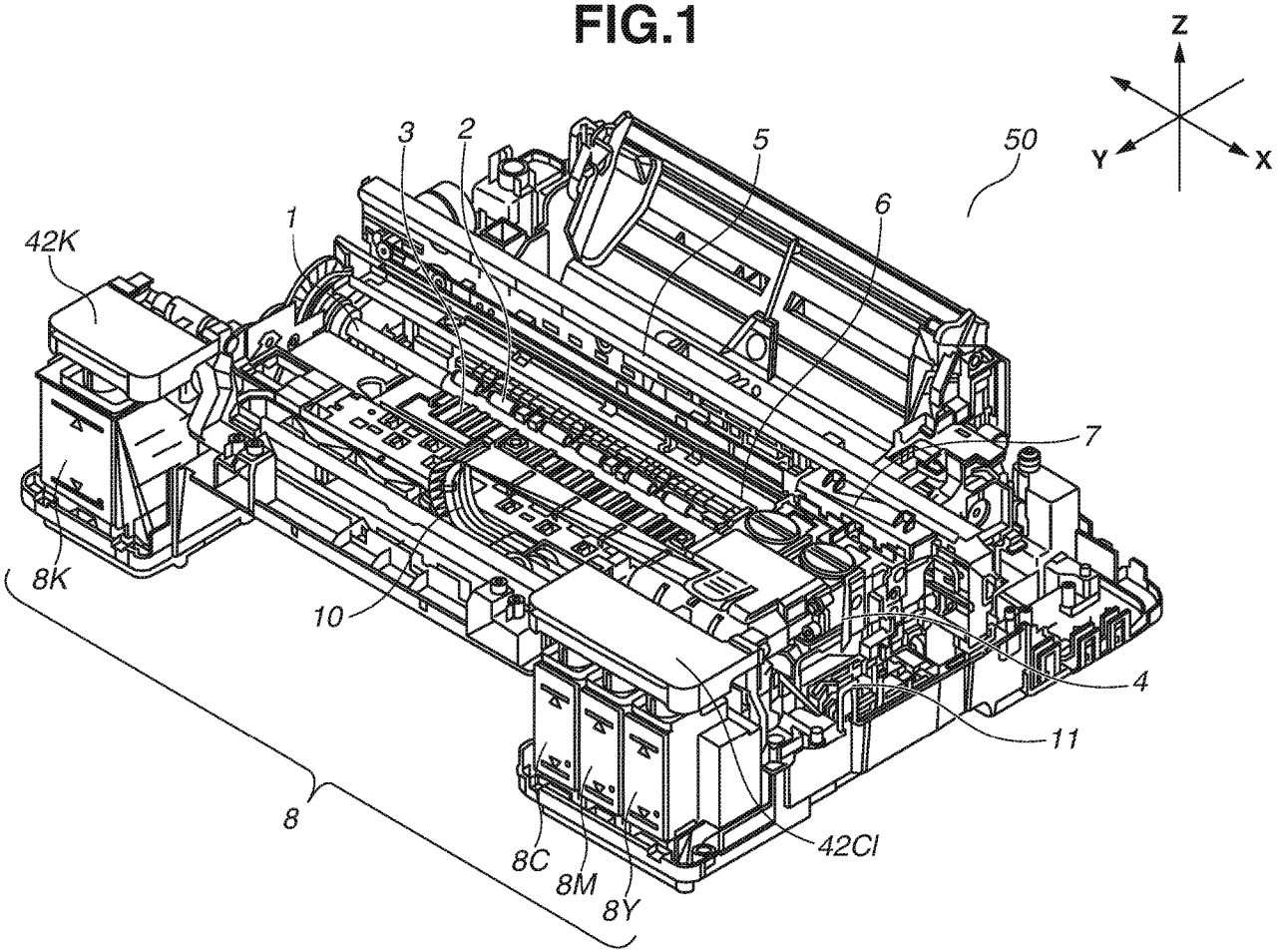
FIG. 1 is a schematic perspective view of an ink jet recording apparatus according to a first example embodiment.

A first example embodiment will be described below. FIG. 1 is a schematic perspective view illustrating an ink jet recording apparatus (hereinafter, recording apparatus) 50 according to the present example embodiment. The recording apparatus 50 includes a feeding roller (not illustrated) that feeds a recording medium, a conveyance roller 1 that conveys a recording medium, and a pinch roller 2 to be driven by the conveyance roller 1. The conveyance roller is a metal roller on which surface minute irregularities are formed so that a friction force is generated. The pinch roller 2 is elastically urged against the conveyance roller 1 by a pressing unit such as a spring (not illustrated).

A recording medium is fed into the recording apparatus 50 by the feed roller. The recording medium fed into the recording apparatus 50 is conveyed vertically above a platen 3 while being held between the conveyance roller 1 and the pinch roller 2. A recording operation is performed on the recording medium by a recording head 4. The platen 3 supports a rear surface (the rear surface is opposite to a surface which is to be subject to recording) of the recording medium so that a predetermined distance is maintained between an ink ejection port surface 31 (see FIG. 2) of the recording head 4 and the recording medium is maintained. The recording medium on which the recording has been completed is conveyed by a discharge roller and a spur roller (not illustrated), to be discharged out of the recording apparatus 50. The discharge roller is a rubber roller, and the spur roller is elastically urged against the discharge roller by the pressing unit such as a spring (not illustrated). A direction where the recording medium is conveyed (a Y direction illustrated in FIG. 1) is referred to as a conveyance direction.

A carriage 7 is moved by a carriage motor 204 (see FIG. 3) along a main scan direction (X direction) which intersects the conveyance direction (Y direction) of a recording medium. In the present example embodiment, the conveyance direction is at a right angle to the main scan direction. The carriage 7 moves in the main scan direction being guided in a vertical direction along a first guide rail 5 and a second guide rail 6. The recording head 4 detachably mounted on the carriage ejects ink droplets while moving in the main scan direction, and performs a recording operation of recording an image for one band on a recording medium. If the image for one band is recorded on the recording medium, the recording medium is conveyed in the conveyance direction by a predetermined amount by the conveyance roller 1 (an intermittent conveyance operation). An image is recorded on the entire recording medium by repeating the recording operation for one band and the intermittent conveyance operation.

In the ink jet recording method, the recording head 4 includes a unit that generates heat as energy to be used for ink ejection (for example, a heating resistance element). High density and high definition of the recording head 4 can be achieved by a method in which an ink state is changed by using the generated heat energy (film boiling). The present disclosure is not limited to the method using the heat energy, and a recording method using vibration energy may also be used.

Figure 2:
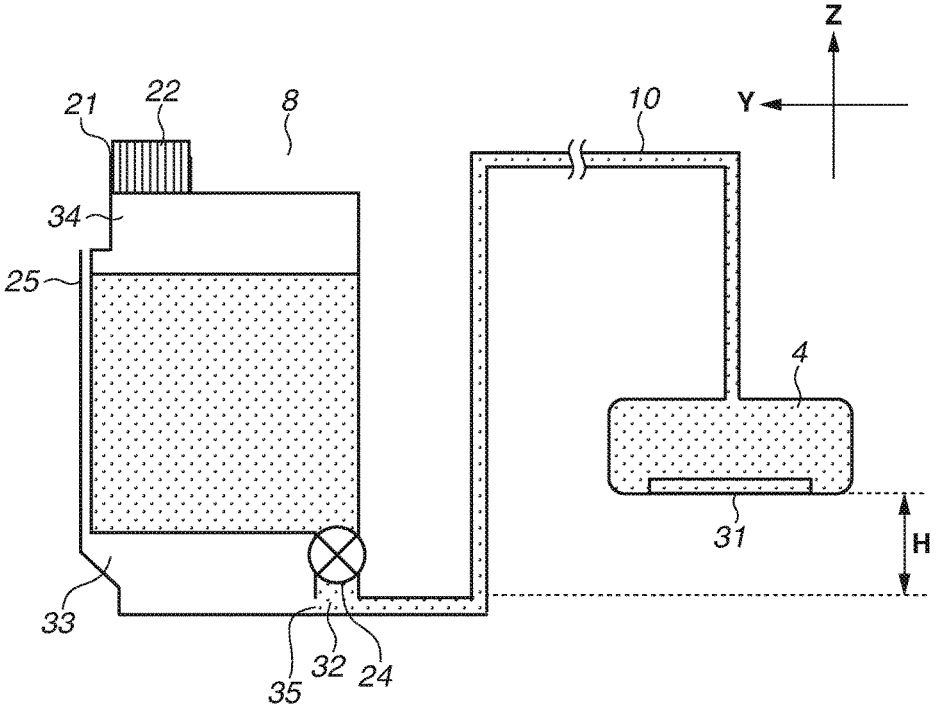
FIG. 2 is a pattern diagram illustrating an ink supply system of the ink jet recording apparatus according to the first example embodiment.

The recording head 4 is configured such that a plurality of ejection port arrays for ejecting ink is disposed for each color on the ink ejection port surface 31 (see FIG. 2). Further, a plurality of ink tanks 8 is fixed to a body of the recording apparatus 50 corresponding to ink to be ejected from the recording head 4. The ink tanks 8 and the recording head 4 are connected to each other by supply tubes (ink supply paths) 10 so that the ink stored in the ink tanks 8 is supplied to the recording head 4.

The ink tanks 8 include a black ink tank 8K and color ink tanks. The black ink tank 8K is disposed on a left side viewed from the front of the recording apparatus 50. The color ink tanks include a cyan ink tank 8C, a magenta ink tank 8M, and a yellow ink tank 8Y. The color ink tanks are disposed on a right side viewed from the front of the recording apparatus 50.

The recording apparatus 50 further includes tank covers 42 which are movable to a covering position where upper surfaces of the ink tanks 8 are covered and an exposing position where the upper surfaces are exposed. The tank covers 42 include a black tank cover 42K and a color tank cover 42CI. The black tank cover 42K is configured to cover the black ink tank 8K. The color tank cover 42CI is configured to collectively cover the cyan ink tank 8C, the magenta ink tank 8M, and the yellow ink tank 8Y.

Further, in the recording apparatus 50, a recovery unit 11 is disposed within a movement region of the carriage 7 in the main scan direction and outside a conveyance region of a recording medium. The recovery unit 11 is disposed opposing the ink ejection port surface 31 of the recording head. 4 (see FIG. 2). The recovery unit 11 includes a cap portion which caps the ink ejection port surface 31, an ink suction mechanism 52 (see FIG. 6) which sucks ink with the ink ejection port surface 31 being capped, and a cleaning blade that scrapes dirt off the ink ejection port surface 31.

FIG. 2 is a schematic pattern diagram illustrating the ink supply system for one-color ink. The supply tube 10 that supplies ink to the recording head 4 is mounted to the ink tank 8. An ink filling port 21 through which a user fills the ink tank 8 with ink is provided on an upper portion of the ink tank 8. Further, a tank cap 22 for sealing the ink filling port 21 is detachably mounted on the ink filling port 21. The user removes the tank cap 22 to open the ink filling port 21 to fill the ink tank 8 with ink.

An ink storage chamber 34 that stores ink to be supplied to the recording head 4 is disposed on an upper portion of the ink tank 8. An air storage chamber 33 that stores air is disposed on a lower portion of the ink tank 8. The ink filling port 21 communicates with the ink storage chamber 34. The ink storage chamber 34 and the air storage chamber 33 are integrally disposed inside the ink tank 8 so that a ceiling surface of the air storage chamber 33 is configured by a part of a bottom surface of the ink storage chamber 34.

The ink storage chamber 34 and the air storage chamber 33 are connected by a connection path 32. The connection path 32 is disposed vertically below the ink storage chamber 34. When ink is supplied from the ink tank 8 to the recording head 4, the connection path 32 stores the ink, and thus functions as a part of the ink storage chamber 34. As illustrated in FIG. 2, the connection path 32 and the air storage chamber 33 are connected to each other on a downstream side of the connection path 32 in a conveyance direction. The connection path 32 and the supply tube 10 are connected to each other on an upstream side of the connection path 32 in the conveyance direction. The supply tube 10 communicates with the air storage chamber 33 at a lower portion of the connection path 32.

The connection path 32 is further provided with a valve unit 24 which allows a switch between a communication state and a non-communication state of the connection path 32. In an open state of the valve unit 24, the connection path 32 is in the communication state. Thus, the ink storage chamber 34 communicates with the air storage chamber 33, and the ink storage chamber 34 communicates also with the supply tube 10. In a close state of the valve unit 24, the connection path 32 is in the non-communication state. Thus, the ink storage chamber 34 does not communicate with the air storage chamber 33, and the ink storage chamber 34 does not communicate also with the supply tube 10.

In the ink tank 8, an atmosphere communication path 25 which extends vertically upward and communicates with external air is disposed on a front side (the downstream side in the conveyance direction) of the recording apparatus 50. The air storage chamber 33 is connected to the atmosphere communication path 25 so as to communicate with atmosphere. In a case where the valve unit 24 provided on the connection path 32 is in the open state, the ink storage chamber 34 communicates with the air storage chamber 33, and thus the ink storage chamber 34 communicates with atmosphere. On the other hand, in a case where the valve unit 24 is in the close state, the ink storage chamber 34 does not communicate with the air storage chamber 33. In a case where the ink filling port 21 is sealed by the tank cap 22, the ink storage chamber 34 does not communicate with atmosphere.

The valve unit 24 is brought into the open state during the recording operation of the recording head 4. Ink ejected from the recording head 4 is continuously supplied from the ink storage chamber 34 to the recording head 4 via the supply tube 10. That is, since the ink moves between the ink storage chamber 34 and the supply tube 10, the connection path 32 functions as an ink flow path.

Further, air, which is equal to an ink amount supplied from the ink storage chamber 34 to the recording head 4 for the recording operation, is supplied from the air storage chamber 33 to the ink storage chamber 34. As described above, since air normally moves between the ink storage chamber 34 and the air storage chamber 33, the connection path 32 functions also as an air flow path. Therefore, only one valve unit 24 allows the switch between the open state and the close state, that is, the switch between the communication state and the non-communication state of both the ink flow path and the air flow path.

Herein, a connecting flow path between the connection path 32 and the air storage chamber 33 functions as a gas-liquid exchange portion 35 in a state where ink is supplied to the recording head 4. This connection flow path has a cross-sectional area such that meniscus of ink is maintained. As a result, the ink is held on the connection path 32, and the ink is suitably supplied to the recording head 4. Further, a water head difference by a height H is caused between the ink ejection port surface 31 and the gas-liquid exchange portion 35, and thus a negative pressure is applied to the ink ejection port surface 31. Therefore, a leakage of the ink from the ink ejection port surface 31 is suppressed.

The air storage chamber 33 further has a role as a buffer chamber which stores ink pushed out of the ink storage chamber 34 when air in the ink storage chamber 34 expands due to a fluctuation in atmospheric pressure or a temperature change. As a result, a leakage of ink from the air communication path 25 is suppressed.

Figure 3:
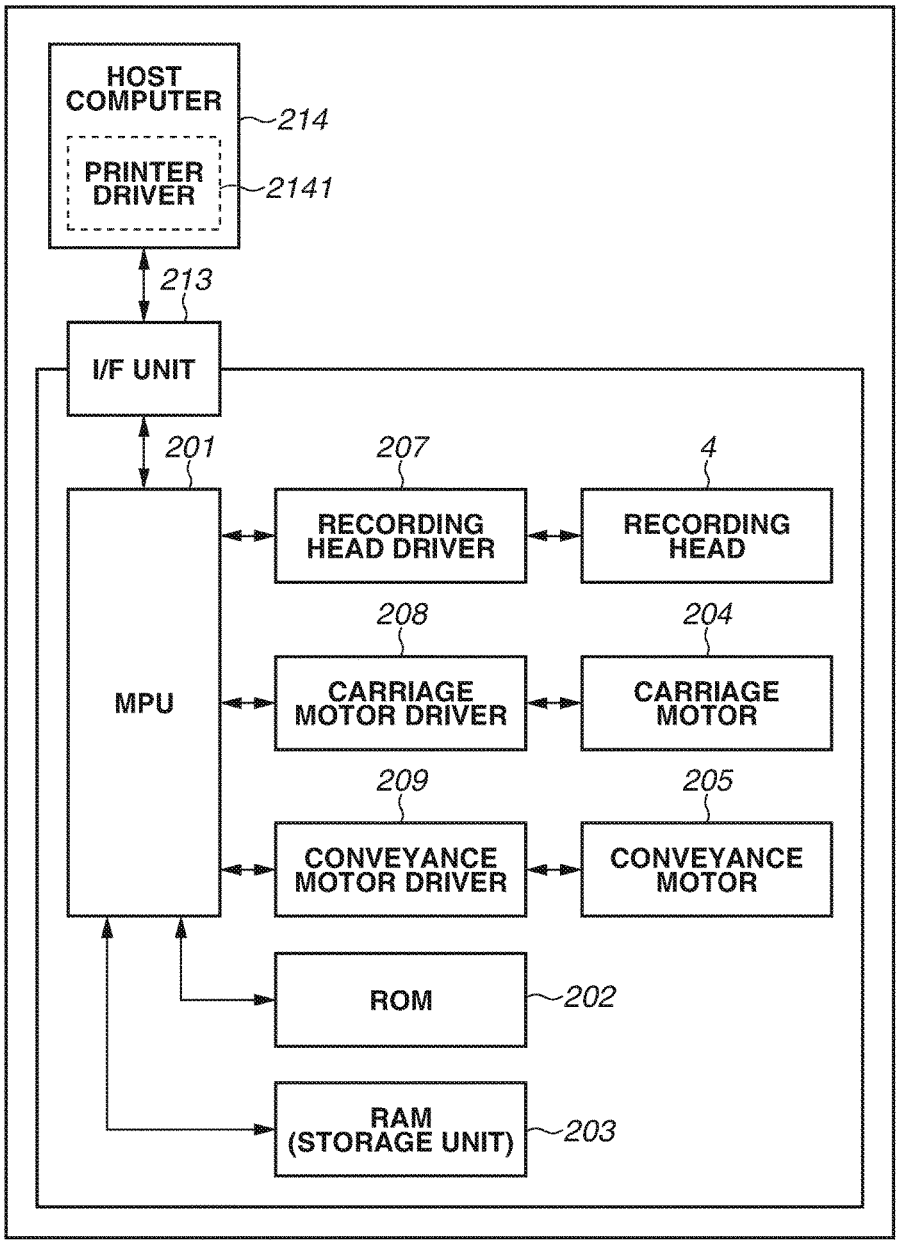
FIG. 3 is a block diagram illustrating a control system of the ink jet recording apparatus according to the first example embodiment.

FIG. 3 is a block diagram illustrating a control system of the recording apparatus 50. A microprocessor unit (MPU) 201 performs controls of the entire recording apparatus 50, such as carrying out operations of respective units and data processing. A read-only memory (ROM) 202 stores programs to be executed by the MPU 201 and various data. A random access memory (RAM) 203 temporarily stores data to be processed by the MPU 201 and data received from a host computer 214.

The recording head 4 is controlled by a recording head driver 207. The carriage motor 204 that drives the carriage 7 is controlled by a carriage motor driver 208. The conveyance roller and the election alter are driven by a conveyance motor 205. The conveyance motor 205 is controlled by a conveyance motor driver 209.

The host computer 214 is provided with a printer driver 2141 for communicating with the recording apparatus 50 to collect and organize recorded images and recording information such as quality of recorded images in a case where a user instructs execution of a recording operation. The MPU 201 exchanges recorded images with the host computer 214 via an interface (I/F) unit 213.

Figure 4A:
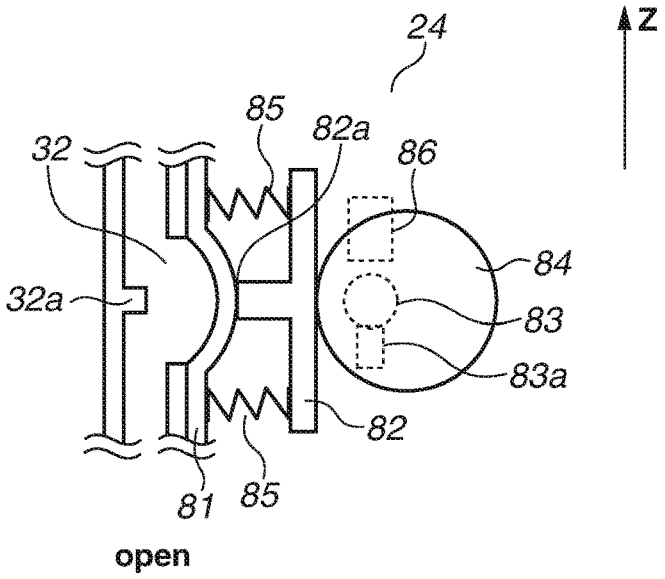
FIGS. 4A and 4B are pattern diagrams illustrating a configuration of a valve unit according to the first example embodiment.
Figure 4B:
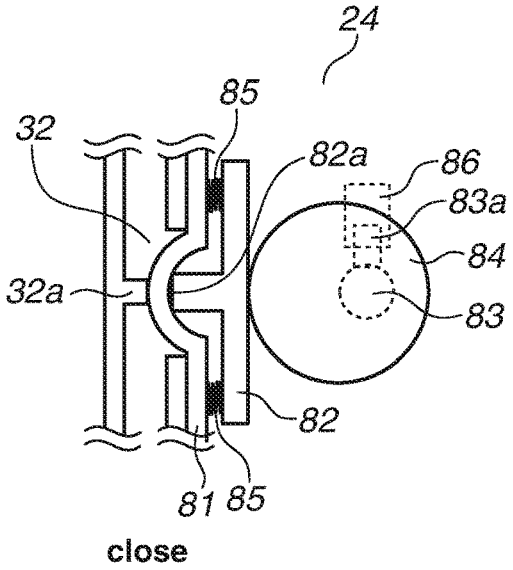

FIGS. 4A and 4B are pattern diagrams illustrating a configuration of the valve unit 24 of a diaphragm type with an enlarged periphery of the valve unit 24 in FIG. 2. FIG. 4A illustrates the open state of the valve unit 24, and FIG. 4B illustrates the close state of the valve unit 24. The valve unit 24 includes a valve member (diaphragm valve) 81, a valve shaft 82, a valve cam 84, and a valve spring 85. The valve member 81 is an elastic member such as a rubber member, and is fixed to a wall surface of the ink tank 8 to cover the connection path. 32 of the ink tank 8. The valve shaft 82 is fixed to the valve member 81 by a fixing portion. 82*a* and is slidable in a lateral direction in FIGS. 4A and 4B. It is desirable that the valve shaft 82 slides in a direction (for example, a horizontal direction) intersecting a vertical direction so as to be capable of switching between the open and close state of the connection path provided in the vertical direction.

The valve spring 85 is a compression spring. One valve spring 85 is disposed above and the other valve spring 85 is disposed below the fixing portion 82*a* of the valve shaft 82 to connect the valve member 81 and the valve shaft 82. The valve shaft 82 is urged toward the valve cam 84 by the valve spring 85. The valve cam 84 is eccentrically provided with respect to a rotary shaft 83, and can be clockwise rotated about the rotary shaft 83 by a stepping motor (not illustrated). A sensor flag 83*a* is disposed integrally on the rotary shaft 83. The sensor flag 83*a* detects a photosensor 86 provided near the valve cam 84 to detect a reference position of the valve cam 84.

A position of the valve cam 84 in the open state of the valve unit. 24 illustrated in FIG. 4A is the reference position of the valve cam 84. At this time, the valve shaft 82 and the valve member 81 are urged toward the valve cam 84 by the two valve springs 85 and are separated from a protrusion portion 32*a* to open the connection path 32 (separate position). FIG. 4B illustrates a state in which the valve cam 84 rotates by 180° from the reference position to move to a pressing position and the valve unit 24 is closed. The valve cam 84 in the pressing position urges the valve shaft 82 and the valve member 81 toward the connection path 32, and thus the valve member 81 comes in contact with the protrusion portion 32*a* provided on the connection path 32 (contact position). The contact between the valve member 81 and the protrusion portion 32*a* blocks the communication of the connection path 32.

Figure 5:
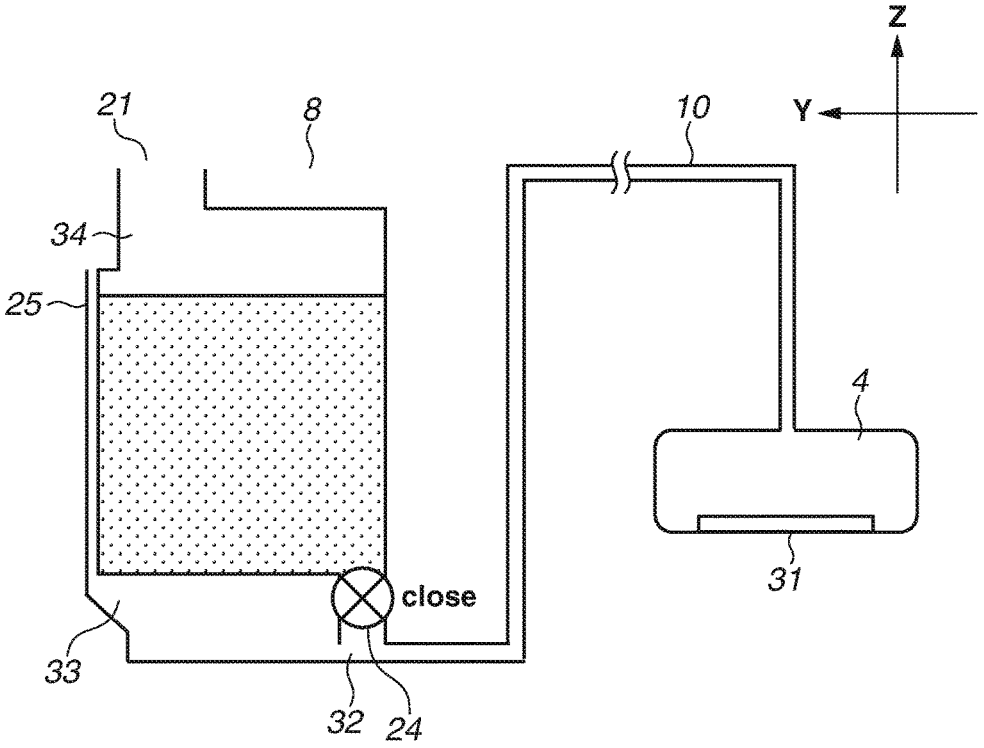
FIG. 5 is a pattern diagram illustrating an ink filling operation to be performed on the ink jet recording apparatus by a user according to the first example embodiment.

An ink filling operation to be performed by a user will be described below with reference to FIG. 5. The user first removes the tank cap 22 from the ink filling port 21 and fills ink from an ink bottle (not illustrated). At this time, the user desirably brings the valve unit 24 into the close state before the removal of the tank cap 22. In the present example embodiment, the tank cover 42 is provided with a sensor, and if the sensor detects that the tank cover 42 has moved to an exposure position, the valve unit 24 is brought into the close state by a drive source (not illustrated).

If the valve unit 24 is brought into the close state, the communication between the ink storage chamber 34 and the air storage chamber 33 is blocked. Therefore, ink can be prevented from flowing into the air storage chamber 33 from the ink storage chamber 34 during the ink filling operation. Further, since communication between the ink storage chamber 34 and the supply tube 10 is also blocked, a pressure change acting on the recording head 4 caused by a liquid surface change of the ink storage chamber 34 which is generated by the ink filling operation is suppressed. That is, an ink leakage from the recording head 4 caused by a rise in positive pressure in the ink flow path is suppressed, and a backflow of ink caused by a rise in negative pressure in the ink flow path is suppressed.

Figure 6:
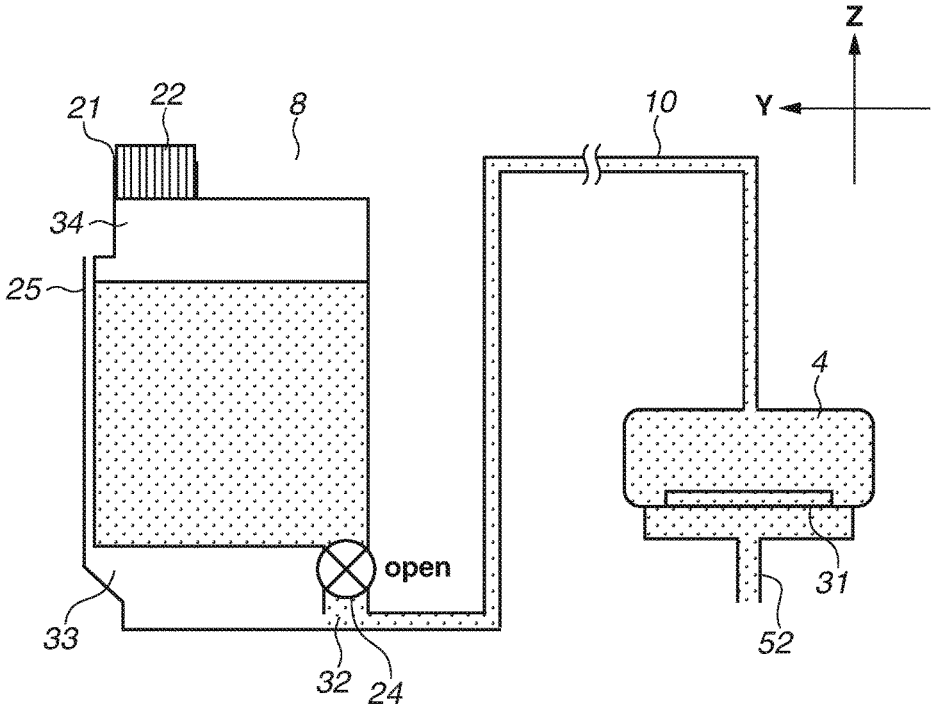
FIG. 6 is a pattern diagram illustrating an initial filling operation to be performed on the ink jet recording apparatus according to the first example embodiment.

When the ink filling operation is completed, the user attaches the tank cap 22 to the ink filling port 21 as illustrated in FIG. 6, and moves the tank cover 42 to the covering position. If the sensor detects that the tank cover 42 has moved to the covering position, the valve unit 24 is brought into the open state by the drive source (not illustrated). As a result, the ink storage chamber 34 communicates with the air storage chamber 33, and the ink storage chamber 34 communicates with atmosphere via the air storage chamber 33. Further, the ink storage chamber 34 also communicates with the supply tube 10, and thus ink supply to the recording head 4 is enabled.

As illustrated in FIG. 6, in a case of a so-called initial filling operation in which the supply tube 10 and the recording head 4 are filled with ink at first, the ink suction mechanism 52 sucks the ink from to recording head 4. The ink tank 8 through the recording head 4 are filled with ink which is equal to an air amount sucked by the ink suction mechanism 52.

Figure 7:
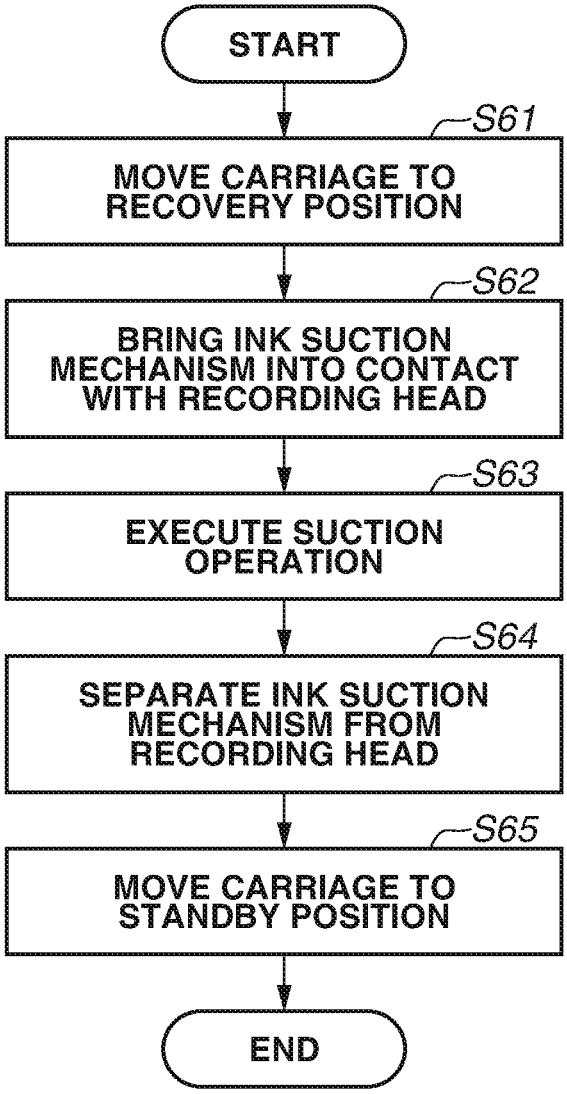
FIG. 7 is a flowchart illustrating an ink suction operation to be performed on the ink jet recording apparatus according to the first example embodiment.

FIG. 7 is a flowchart illustrating the ink suction operation. The ink suction operation is performed during a recovery operation of the recording head 4 as well as the above-described initial filling operation. In step S61, the carriage 7 is moved by an instruction of the MPU 201 to a recovery position where the recording head 4 opposes the recovery unit 11. In step S62, the MPU 201 brings the ink suction mechanism 52 into contact with the ink ejection port surface 31. In step S63, the MPU 201 causes the ink suction mechanism 52 to perform the operation for sucking ink from the recording head 4. In step S64, the MPU 201 separates the ink suction mechanism 52 from the recording head 4, and in step S65, moves the carriage 7 from the recovery position to a standby position. The MPU 201 then ends the process.

The recording apparatus 50 may be transported after a user performs the initial filling operation to start using the recording apparatus 50, in order to use it in a different place. This transportation is referred to as secondary transportation. If the secondary transportation is carried out with the recording head 4 or the supply tube 10 being filled with ink, the filled ink expands due to changes in atmospheric pressure or an ambient temperature, and thus the ink might leak from the ink ejection port surface 31. Further, if the recording apparatus 50 is tilted during the secondary transportation, meniscus may be broken in the gas-liquid exchange portion 35. Thus, the ink in the ink storage chamber 34 flows into the air storage chamber 33, and the ink might leak from the atmosphere communication path 25.

Therefore, in the present example embodiment, the valve unit 24 is brought into the close state before the secondary transportation. As a result, the flow of the ink from the ink storage chamber 34 into the air storage chamber 33, and the flow of ink from the ink storage chamber 34 into the supply tube 10 are blocked. Further, the ink suction operation is performed while the valve unit 24 is in the close state, so that the ink is discharged out of the recording head 4 and the supply tube 10.

Figure 8:
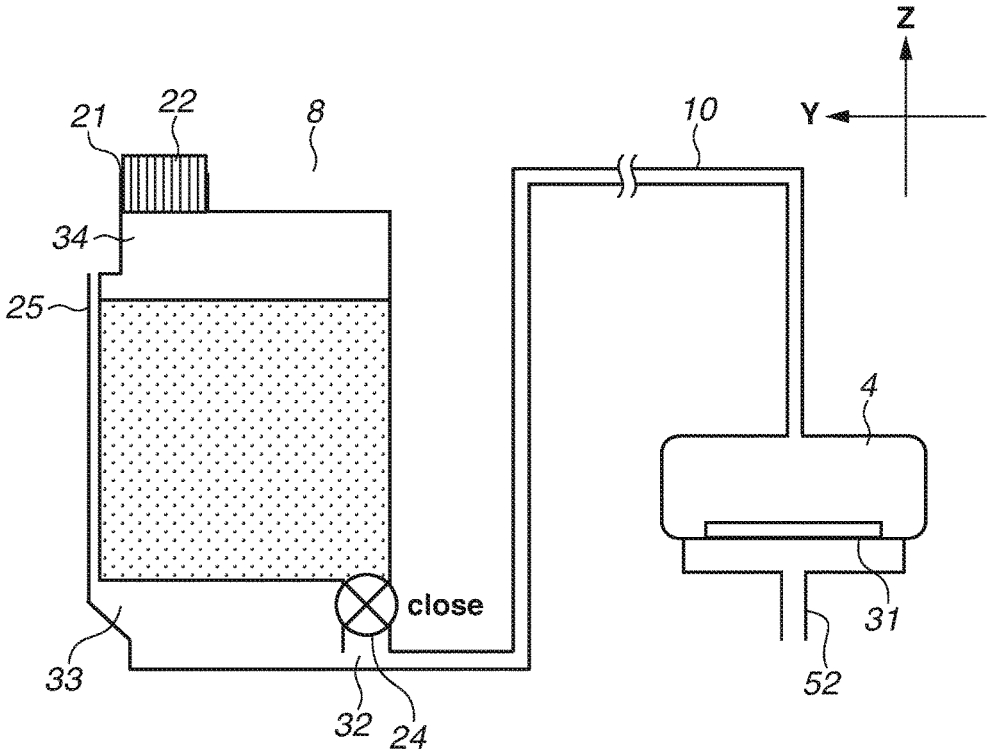
FIG. 8 is a pattern diagram illustrating how the ink suction operation is performed for secondary transportation of the ink jet recording apparatus according to the first example embodiment.

Specifically, if the user selects a transportation mode on an operation panel, not illustrated, provided to the recording apparatus 50, the MPU 201 brings the valve unit 24 into the close state. In this state, the flowchart of the ink suction operation illustrated in FIG. 7 is performed by the MPU 201. FIG. 8 illustrates a state in which the ink suction operation is performed for the secondary transportation.

As illustrated in FIG. 8, the ink suction mechanism 52 discharges ink in the recording head 4 and in the supply tube 10. Further, if ink is accumulated in the air storage chamber 33, the ink in the air storage chamber 33 is also sucked and discharged via the supply tube 10 and a lower portion of the connection path 32. If the flowchart of the ink suction operation illustrated in FIG. 7 is completed, the recording apparatus 50 is powered off with the valve unit 24 being maintained in the close state. In such a manner, the recording apparatus 50 becomes ready for the second transportation.

As described above, since the valve unit 24 is disposed on the connection path 32, ink in the ink storage chamber 34 is not excessively discharged and only the ink in the ink flow path can be discharged. Further, since the supply tube 10 is connected to the air storage chamber 33 without passing through the ink storage chamber 34, if the ink suction operation is performed with the valve unit 24 being in the close state, not only ink in the supply tube 10 but also ink in the air storage chamber 33 can be discharged. Therefore, a leakage of ink from both the ink ejection port surface 31 and the atmosphere communication path 25 can be suppressed during transportation.

In the present example embodiment, one valve unit 24 is provided, but the configuration is not limited to this, and two valves may be provided. That is, the scope of the present disclosure includes also a configuration such that an ink connection path for connecting the supply tube 10 and the ink storage chamber 34, and a buffer connection path for connecting the air storage chamber 33 and the ink storage chamber 34 are provided. Further, a first valve and a second valve are provided in these connection paths, respectively. The first valve and the second valve are configured to together switch between the open state and the close state in the ink filling operation or the ink suction operation, but may be configured to switch between the open state and the close state individually at the time of performing other operations. Further, the configuration is not limited to the valve unit 24 which is opened or closed by the drive source. The valve unit 24 may be configured to be opened or closed in conjunction with the open or close state of the tank cover 42.

Figure 9:
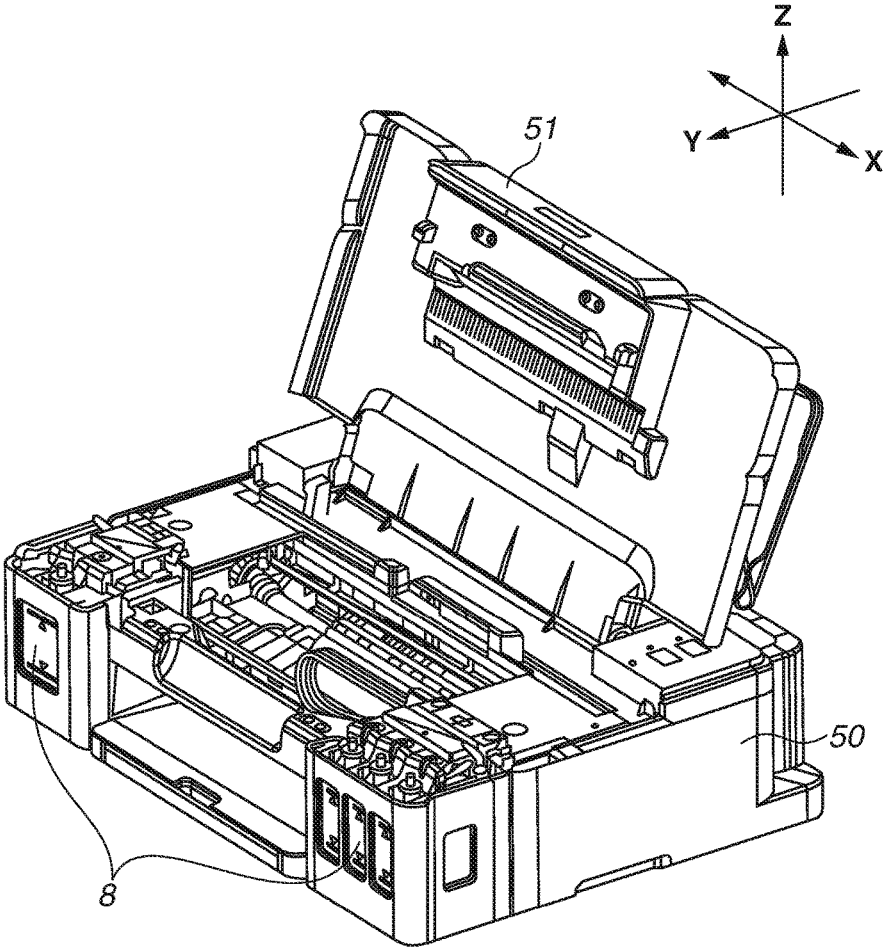
FIG. 9 is a schematic perspective view of the ink jet recording apparatus according to a second example embodiment.

A second example embodiment will be described with reference to FIG. 9. FIG. 9 is a perspective view illustrating an outline of the recording apparatus 50 according to the present example embodiment. In the first example embodiment, the black tank cover 42K and the color tank cover 42CI are provided for the black ink tank 8K and the color ink tanks, respectively. In the present example embodiment, the tank cover 42 is not provided, but a main body cover 51 of the recording apparatus 50 is provided to be opened and closed for the recording apparatus 50.

A sensor is provided also in the main body cover 51, and thus the valve unit 24 can be selectively opened or closed based on a result of detecting an open/close state of the main body cover 51. The present example embodiment is similar to the first example embodiment in that the open/close state of the valve unit 24 is controlled at the time of the ink filling operation by a user, or at the time of the ink suction operation for the secondary transportation. In a case of the recording apparatus 50 mounted with a scanner unit or an automatic document feeder (ADF) instead of the main body cover 51, the scanner unit or the ADF may be configured such that their open/close state can be detected to obtain a similar effect.

That is, according to the present disclosure, an outflow of ink can be suppressed in an ink jet recording apparatus including an ink tank having a filling port.

While the present disclosure has been described with reference to numerous example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-089516, filed Apr. 28, 2017, which is hereby incorporated by reference herein in its entirety.

What is claimed is:

1. An ink jet recording apparatus comprising:

a recording head that ejects ink;

an ink tank including an ink storage chamber configured to store ink, an air storage chamber configured to communicate with atmosphere, and a connection path configured to connect the ink storage chamber and the air storage chamber;

an ink supply path that connects the connection path and the recording head;

a valve provided on the connection path and configured to be switched between an open state in which the ink storage chamber communicates with the ink supply path and with the air storage chamber, and a close state in which the communication between the ink storage chamber and the ink supply path is blocked and the communication between the ink storage chamber and the air storage chamber is blocked, the valve does not block a communication between the ink supply path and the air storage chamber;

a valve shaft that switches the valve between the open state and the close state; and an ink suction mechanism to perform an ink suction operation with the valve being in the close state for sucking ink from the recording head, the ink supply path and the air storage chamber.

2. The ink jet recording apparatus according to claim 1, wherein in a case where a user selects a transportation mode, the valve is brought into the close state and the ink suction operation is performed.

3. The ink jet recording apparatus according to claim 1, wherein the ink storage chamber is provided with a filling port for filling the ink.

4. The ink jet recording apparatus according to claim 3, wherein in a case where ink is filled through the filling port, the valve is in the close state.

5. The ink jet recording apparatus according to claim 3, further comprising a tank cap for sealing the filling port.

6. The ink jet recording apparatus according to claim 3, further comprising a tank cover which is movable to a covering position where the filling port is covered and an exposing position where the filling port is exposed.

7. The ink jet recording apparatus according to claim 6, wherein the valve is brought into the close state by the switching means when the tank cover is moved from the covering position to the exposing position.

8. The ink jet recording apparatus according to claim 7, wherein the valve is brought into the open state by the switching means when the tank cover is moved from the exposing position to the covering position.

9. The ink jet recording apparatus according to claim 1, wherein the ink tank is fixed to an apparatus main body, and the ink storage chamber is placed above the air storage chamber in a gravitational direction.

10. The ink jet recording apparatus according to claim 1, wherein in a state where the ink is supplied from the ink tank to the recording head, a flow path for connecting the ink storage chamber and the air storage chamber has such a cross-sectional area that meniscus of the ink is maintained.

11. The ink jet recording apparatus according to claim 1, wherein the valve includes a diaphragm valve, and a protrusion portion provided in the connection path opposing the diaphragm valve, and the switching means moves the diaphragm valve to a contact position where the diaphragm valve comes in contact with the protrusion portion and blocks the connection path, and to a separated position where the diaphragm valve is separated from the protrusion portion and opens the connection path.

12. The ink jet recording apparatus according to claim 1, wherein the ink suction mechanism includes a cap portion which caps an ejection port surface provided with a plurality of ejection ports on the recording head.

* * * * *